United States Patent [19]

Achelpohl et al.

[11] Patent Number: 5,054,763

[45] Date of Patent: Oct. 8, 1991

[54] APPARATUS FOR DIVIDING A CONTINUOUSLY CONVEYED STREAM OF SHINGLED WORKPIECES

[75] Inventors: Fritz Achelpohl; Richard Feldkamper, both of Lengerich, Fed. Rep. of Germany

[73] Assignee: Windmoller & Holscher, Lengerich, Fed. Rep. of Germany

[21] Appl. No.: 604,644

[22] Filed: Oct. 29, 1990

[30] Foreign Application Priority Data

Dec. 13, 1989 [DE] Fed. Rep. of Germany ..... 3941184

[51] Int. Cl.[5] ..... B65H 29/68

[52] U.S. Cl. ..... 271/182; 198/419.3; 271/202; 271/270

[58] Field of Search ..... 198/419.3; 271/202, 271/198, 270, 182, 151, 216, 69, 272, 273

[56] References Cited

U.S. PATENT DOCUMENTS

| | | | |
|---|---|---|---|
| 2,852,256 | 9/1958 | Faulls et al. | 271/202 X |
| 3,724,840 | 4/1973 | Kuckhermann | 271/270 X |
| 3,964,598 | 6/1976 | Alsop | 198/419.3 X |
| 4,183,518 | 1/1980 | Brockmuller et al. | 271/202 X |
| 4,552,261 | 9/1985 | Raudat et al. | 198/419.3 |

*Primary Examiner*—Joseph E. Valenza
*Assistant Examiner*—Keith L. Dixon
*Attorney, Agent, or Firm*—Fleit, Jacobson, Cohn, Price, Holman & Stern

[57] ABSTRACT

An apparatus for dividing a continuously conveyed stream of shingled workpieces, such as bags or sacks, into leading and trailing parts has two consecutive endless belt conveyors. The downstream second belt conveyor is driven, during a dividing operation, at a higher velocity than the first upstream conveyor in order to pull the shingled stream apart. After the stream has been divided into the leading and trailing parts the second conveyor is driven at the same velocity as the first conveyor. To provide separation of the stream into parts consisting of an exactly predetermined number of workpieces, an intermediate endless belt conveyor is provided, which extends parallel to the trailing portion of the second belt conveyor and during the dividing operation revolves at a lower velocity than the second belt conveyor. The intermediate conveyor is provided with cams for arresting the leading workpiece of the trailing part of the shingled stream, against an upper pressure belt.

7 Claims, 2 Drawing Sheets

APPARATUS FOR DIVIDING A CONTINUOUSLY CONVEYED STREAM OF SHINGLED WORKPIECES

BACKGROUND OF THE INVENTION

1. Field of the Invention

This invention relates to an apparatus for dividing a continuously conveyed stream of shingled workpieces, such as bags or sacks into leading and trailing parts, comprising two consecutive endless belt conveyors, wherein the downstream or second belt conveyor is driven during a dividing operation, at a higher velocity than the first or upstream conveyor in order to pull the shingled stream apart and after the shingled stream has been divided into the leading and trailing parts is driven at the same velocity as the first conveyor, the apparatus also comprising separating means provided between the belt conveyors.

2. Description of the Prior Art

In an apparatus of the above kind, which is disclosed in Published German Patent Application 28 52 603, the separating means comprises an endless separating conveyor, which overlies the second belt conveyor and is adapted to be driven independently of the first belt conveyor. The separating conveyor is provided over a portion of its periphery with cross-cleats, which receive the shingled stream from the first belt conveyor and hold said stream over the second belt conveyor so that the second belt conveyor pulls the shingled stream apart to form a gap therein. The known apparatus cannot be used to achieve a satisfactory division of the shingled stream in such a manner that leading parts consisting of an exactly predeterminable number of workpieces can be separated from the shingled stream because in the operation of the known apparatus it is not possible reliably to predict the point at which the shingled stream will be pulled apart. Specifically, in the operation of the known apparatus problems will arise in the division of a shingled stream which consists of thin, limp workpieces.

SUMMARY OF THE INVENTION

It is an object of the invention to provide an apparatus of the kind described which can be used to separate a leading part, consisting of an exactly predetermined number of workpieces, from the trailing part of a shingled stream. Also, it is an object of the invention to provide an apparatus by which shingled streams consisting of thin, limp workpieces can be thus divided.

In accordance with the invention the separating means comprises an intermediate endless belt conveyor, which extends parallel to the trailing portion of the second belt conveyor and during the dividing operation revolves at a lower velocity than the second belt conveyor and is provided with means for retaining at least the leading workpiece of the trailing part of the shingled stream. In the operation of the apparatus, the leading workpiece of the trailing part of the shingled stream is retained on the intermediate belt conveyor and is fixed to the latter so that the shingled stream can be pulled apart at a predetermined point to form a gap therein and a shifting of individual workpieces of the parts of the shingled stream will be prevented even if such workpieces consist of thin, limp material.

Preferably, the intermediate belt conveyor may consist of at least two parallel intermediate belts, positioned laterally between conveying outer courses of the second belt conveyor and which are respectively provided with equally spaced apart pairs of cams. The intermediate belts extend below the plane of conveyance of the conveying courses of the second belt conveyor, and the cams project above the plane of conveyance of the intermediate belt conveyor during the dividing operation which is performed during intermittent operation of the apparatus. Endless back pressure belts may be provided above the belts of the intermediate belt conveyor so that the cams force the leading end of the trailing part of the shingled stream against said endless back pressure belts. This arrangement ensures that with proper control of the drive means for the intermediate belt conveyor, the cams clamp the leading workpiece of the trailing part of the shingled stream against the back pressure belts, so that the shingled stream will be divided exactly at a predetermined point and the separated leading part of the shingled stream can be carried away at a higher velocity whereby a gap will be formed in the shingled stream.

It will be understood that the belts of the second belt conveyor may, alternatively, extend between the belts of the intermediate belt conveyor.

When the intermediate belt conveyor is in a stand-by condition, it is arranged that the pair of cams provided on each belt of the intermediate belt conveyor will be disposed adjacent to the forward the rear generatrices, respectively, of the reversing pulleys for the belts.

The cams interchange their positions during a dividing operation, in which the cams move along the upper courses of the belts.

The endless back pressure belts are preferably trained around freely rotatably mounted reversing pulleys, which are freely rotatably mounted at the ends of pivoted oblique links. The required pressure is applied by the back pressure belts under the weight of the associated reversing pulleys and links.

The links are preferably interconnected by coupling bars to form a parallel-crank four-bar linkage.

In accordance with a further feature of the invention, fluid-operable cylinders may be pivoted to the machine frame above the upper courses of the back pressure belts and have piston rods, which at their free ends carry pressure pads. At the beginning of the dividing operation the pressure pads are lowered onto a non-overlapping portion of the trailing workpiece of the leading part of the shingled stream to be divided. In such an arrangement the leading workpiece of the trailing part of the shingled stream and the trailing workpiece of the leading part of the shingled stream are clamped in position so that the differential velocities will ensure that the shingled stream will reliably be pulled apart, while avoiding uncontrolled shifting of the workpieces.

A spring may be provided for restoring the cylinders when the piston rod has been retracted and for urging the cylinders against a stop in a stand-by position.

The pivotal mountings for the cylinders and the stops are preferably adjustable in the longitudinal direction for an adjustment to workpieces having different lengths.

The cylinders may be a pneumatic cylinders.

The distance from the projections of the continuations of the cylinders on the shingled stream to the upper center lines of the rear reversing pulleys of the intermediate belt conveyor may approximately correspond to one workpiece length in such a manner that the trailing cams during their revolution will clamp the leading workpiece of the trailing part of the shingled stream and the pressure pads will engage the trailing workpiece of the leading part of the shingled stream.

BRIEF DESCRIPTION OF THE DRAWING

FIG. 2 shows only a part of the apparatus which is disposed under the plane of the shingled stream.

DETAILED DESCRIPTION OF THE PREFERRED EMBODIMENT

Figure 1:
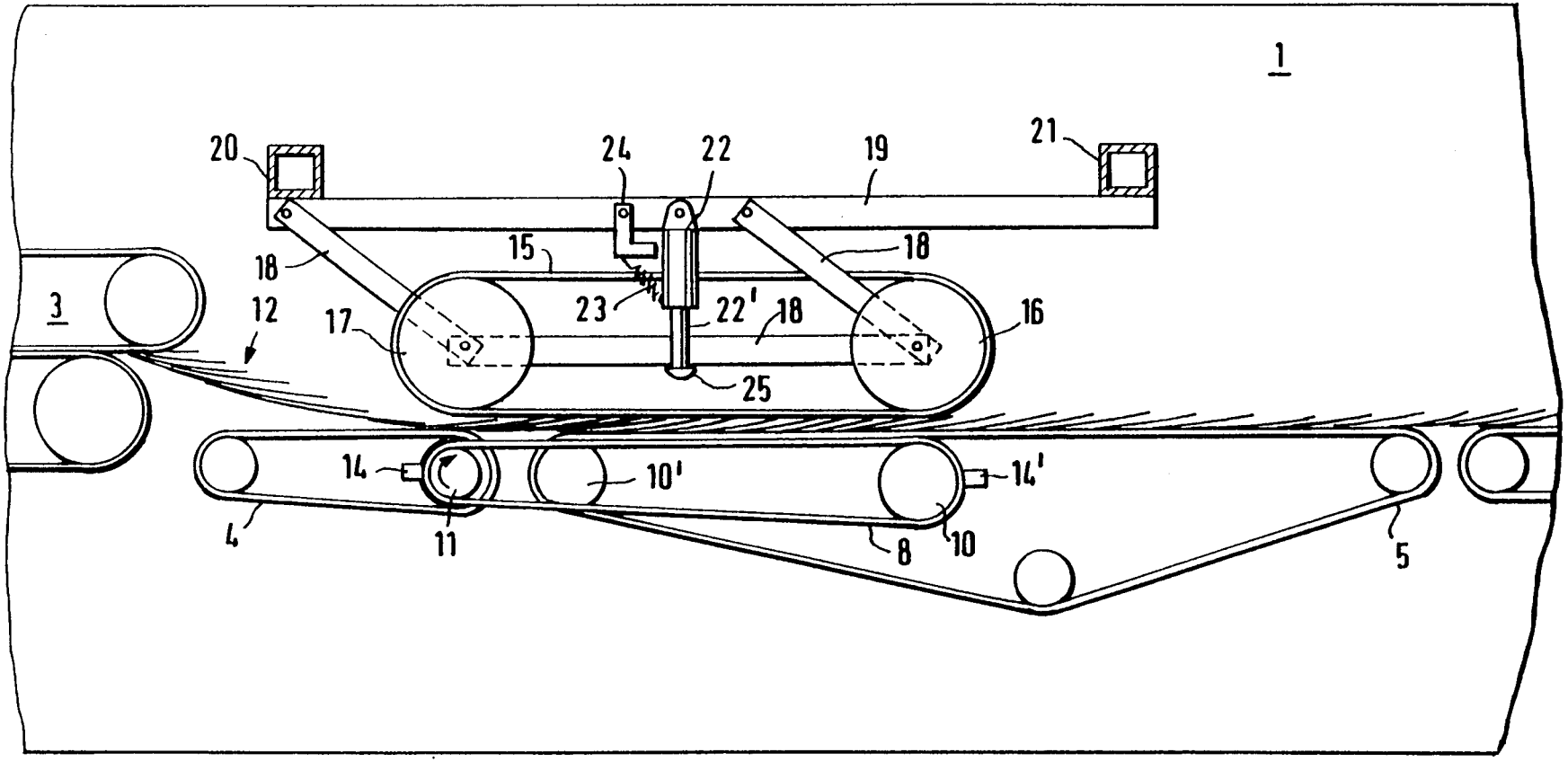
FIG. 1 is a side elevational view of an apparatus for dividing a shingled stream.

An illustrative embodiment of the invention will now be described more in detail with reference to the drawing.

FIG. 1 shows only a rear side wall 1 of two side walls 1, 2, of a machine frame between which a feeding conveyor belt 3 is movably mounted. The feeding conveyor belt 3 is succeeded by a first conveyor 4 comprising a pair of conveyor belts 4' and 4'', which extend in a plane disposed below the plane of the feeding belt 3 and are succeeded by a second conveyor 5 comprising a pair of conveyor belts 5'and 5''. Each of the conveyors 4 and 5 are adapted to be driven by a separate motor 6 and 7. As is particularly apparent from FIG. 2 the belts of the two conveyors 4 and 5 are overlapped by an intermediate conveyor 8 comprising a pair of intermediate conveyor belts 8' and 8'', which are driven by a separate motor via the shaft 10, around which the two belts 8' and 8'' are trained in the shape of loops. As is apparent from FIG. 1, a second shaft 10' is rotatably mounted in the two side walls 1 and 2 in such a manner that the two conveyor belts 8' and 8'' extend below the plane of the pair of conveyor belts 5' and 5''. The conveyor belts 8 and 8'' are trained around a third shaft 11, which serves also to reverse the pair of conveyor belts 4' and 4''. In order to ensure that the pair of intermediate conveyor belts extend several times in a plane which is disposed below the plane in which a shingled stream of sack or the like 12 is disposed while traversing conveyors 4 and 5, the shaft 11 is stepped to be smaller in diameter in the region around which the conveyor belts 8' and 8'' are trained than in the region in which the conveyor belts 4 and 4'' are trained around the shaft 11. The offset portions 13 of the shaft 11 around which the conveyor belts 4' and 4'' are trained are constituted by free wheel or freely rotatably mounted bushings so that the pairs of conveyor belts 4', 4'' and 8', 8'' can be driven independently of each other by the associated motors 6 and 9, respectively. The conveyor belts 8' and 8'' carry cams 14, which during uninterrupted conveyance of stream 12 are in the position shown in FIGS. 1 and 2. A back pressure belt 15 is provided above the conveyors 4, 5 and contacts the shingled stream 12 from above. The back pressure belt 15 is trained around two pulleys 16 and 17, which are connected by a parallel-crank linkage 18 to a longitudinal beam 19, which is fixedly connected to two cross-beams 20 and 21, carried by the side walls 1 and 2. A piston-cylinder unit 22 is pivoted to the longitudinal beam 19 and is urged by a spring 23 against a stop 24. A pressure pad 25 is mounted on the free end of the piston 22' of the piston-cylinder unit 22 and preferably consists of elastic cylinder unit 22 to the pulley 27 can be adjusted by means not shown so that the pressure pad 25 on the fully extended piston rod 22' will be forced against the leading end of a sack which is no longer engaged by the cam 14.

Figure 2:
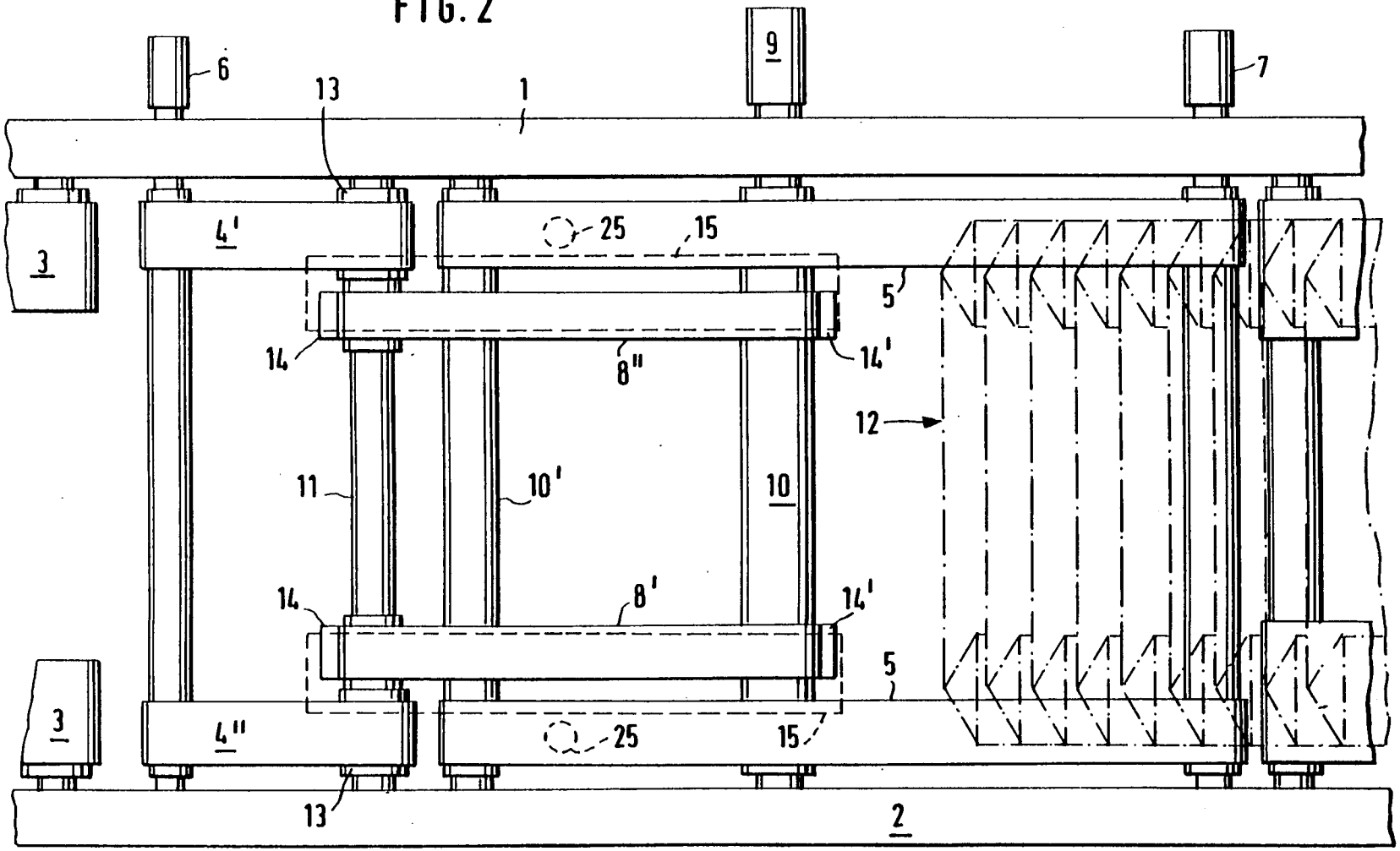
FIG. 2 is a top plan view of the apparatus of FIG. 1. For the sake of clarity.

When a separation of sacks is desired, the motor 9 for the pair of intermediate conveyor belts 8', 8'' is started so that the cam 14 shown on the left in FIG. 1 moves in a clockwise sense and acts from below on the shingled stream 12, which is thus raised and forced against the back pressure belt 15. Belt 15 is raised about the pivots connecting the parallel-crank linkage 18 to the longitudinal beam 19. Thereafter the motor 7 associated with the pair of conveyor belts 5', 5'' is operated at a higher speed than the two motors 6 and 9 moving at the same speed so that part of the shingled stream which is downstream of the left-hand cam 14 will be carried away at a high velocity. In order to ensure a neat separation, the effect of the acceleration of the pair of conveyor belts 5', 5'' caused by the higher speed of the motor 7 is assisted in that the pad 25 of the piston-cylinder unit 22 is moved down against the leading edge of the trailing workpiece of the downstream part of the shingled stream which is to be carried away at a high velocity and the trailing sack is forced by the pad 25 against a conveyor belt of the pair 5', 5''. Thereafter the piston-cylinder unit performs a counterclockwise pivotal movement about the pivot connecting that unit to the longitudinal beam 19 (caused by movement of belts 5', 5'') and the piston rod 22' is extended at the same time. Shortly thereafter the piston rod 22' is retracted to remove pad 25 from the trailing sack and the spring 23 restores the piston-cylinder unit into engagement with the stop 24. As soon as the cam 14 shown on the left in FIG. 1 has been moved to the position which is occupied by the cam 14' in FIG. 1, the motor 9 for the pair of intermediate conveyor belts 8 is turned off and the speed of the motor 7 for the second pair of conveyor belts 5, 5'' is reduced so that the motors 6 and 7 now run at the same speed. At that time the shingled stream 12 is again engaged by a portion of the back pressure belt 15, as shown in FIG. 2.

For the sake of simplicity, reference has been made hereinbefore to only one back pressure belt 15 and to only one piston-cylinder unit 22. It is apparent from FIG. 2 that the means for pressing down the shingled stream as shown in FIG. 1 are provided twice in that a back pressure belt 5 and a piston-cylinder unit 22 are provided on each side of the pair of first conveyor belts and of the pair of second conveyor belts.

We claim:

1. An apparatus for dividing a continuously conveyed stream of shingled workpieces, such as bags or sacks, into leading and trailing parts, comprising' consecutive upstream and downstream endless belt conveyors, drive means for driving the downstream belt conveyor during a dividing operation at a higher velocity than the upstream conveyor in order to pull the stream apart, and after the shingled stream has been divided into the leading and trailing parts, for driving the downstream conveyor at the same velocity as the upstream conveyor, separating means between the belt conveyors comprising an intermediate endless belt conveyor, extending in parallel to a trailing portion of the downstream belt conveyor for moving during the dividing operation at a lower velocity than the downstream belt conveyor, and retaining means on the intermediate belt conveyor for arresting at least a leading workpiece of the trailing part of the shingled stream during the dividing operation.

2. An apparatus according to claim 1, wherein the intermediate belt conveyor comprises at least two parallel intermediate belts located between spaced downstream conveying belts which define the downstream belt conveyor and wherein the retaining means comprises equally spaced apart pairs of cams on the respective intermediate belts, the intermediate belts being located below a plane of conveyance of the downstream conveyor, the cams being configured to extend above a plane of conveyance of the intermediate belt conveyor during the dividing operation, and the apparatus including endless back pressure belts above the intermediate belt conveyor positioned for the cams to force the leading end of the trailing part of the shingled stream against during the dividing operation.

3. An apparatus according to claim 2, wherein the endless back pressure belts are trained around reversing pulleys, which are freely rotatably mounted at the ends of oblique pivoted links.

4. An apparatus according to claim 3, wherein the links are connected by coupling bars to form a parallel-crank four-bar linkage.

5. An apparatus according to claim 2 which includes a machine frame and fluid-operable cylinders pivoted to the machine frame above the back pressure belts, the cylinders having piston rods which at free ends thereof carry pressure pads for lowering onto a non-overlapping portion of a trailing workpiece of the leading part of the shingled stream during the dividing operation.

6. An apparatus according to claim 5, wherein the cylinders have pivotal mountings on the frame which are adjustable in a longitudinal direction of the conveyors.

7. An apparatus according to claim 5, wherein a measured distance from projections of said cylinders onto the shingled stream to center lines of rear reversing pulleys of the intermediate belt conveyor approximately corresponds to the length of one workpiece in the stream whereby the cams during movement of the intermediate conveyor will clamp the leading workpiece of the trailing part of the shingled stream and the pressure pads will engage the trailing workpiece of the leading part of the shingled stream.

* * * * *